United States Patent [19]

Redl

[11] Patent Number: 5,056,980

[45] Date of Patent: Oct. 15, 1991

[54] APPARATUS FOR TRANSPORTING AND EMPTYING SACKS FILLED WITH BULK MATERIAL

[75] Inventor: Simon Redl, Reichertshausen, Fed. Rep. of Germany

[73] Assignee: Anton Steinecker Maschinenfabrik GmbH, Fed. Rep. of Germany

[21] Appl. No.: 518,068

[22] Filed: May 2, 1990

[30] Foreign Application Priority Data

May 2, 1989 [DE] Fed. Rep. of Germany ..... 3914459

[51] Int. Cl.[5] ..... B65B 69/00; B65B 9/00

[52] U.S. Cl. ..... 414/412; 414/411; 53/381.1

[58] Field of Search ..... 414/411, 412; 53/381 R, 53/492; 83/425, 425.1, 434

[56] References Cited

U.S. PATENT DOCUMENTS

| | | | |
|---|---|---|---|
| 2,660,324 | 11/1953 | Trautschold | 414/412 |
| 2,692,502 | 10/1954 | Warren . | |
| 3,447,706 | 6/1969 | Moriarty | 414/412 |
| 3,467,267 | 9/1969 | Van Elten | 414/412 |
| 3,482,718 | 12/1969 | Moriarty | 414/412 |
| 3,606,057 | 9/1971 | June | 414/412 |
| 3,680,725 | 8/1972 | Poulton | 414/412 |
| 3,811,586 | 5/1974 | Lavoie | 198/624 X |
| 4,252,489 | 2/1981 | Mechalas | 414/412 |
| 4,274,787 | 6/1981 | Mueller et al. | 414/412 |
| 4,278,384 | 7/1981 | Marchesini | 414/412 |
| 4,279,558 | 7/1981 | Lavoie | 414/412 |
| 4,543,029 | 9/1985 | Grün et al. | 414/412 |
| 4,555,212 | 11/1985 | Jones | 414/412 |
| 4,859,132 | 8/1989 | Chasseray | 414/412 |
| 4,930,968 | 6/1990 | Borglund | 414/412 |

FOREIGN PATENT DOCUMENTS

| | | | |
|---|---|---|---|
| 2453542 | 12/1974 | Fed. Rep. of Germany | 414/412 |
| 8105283 | 6/1983 | Netherlands | 414/412 |
| 621615 | 8/1978 | U.S.S.R. | 414/412 |
| 1188053 | 10/1985 | U.S.S.R. | 414/412 |
| 1105006 | 3/1968 | United Kingdom . | |
| 1184314 | 3/1970 | United Kingdom . | |
| 2137157 | 10/1984 | United Kingdom . | |

*Primary Examiner*—Frank E. Werner
*Assistant Examiner*—Brian K. Dinicola
*Attorney, Agent, or Firm*—Seed and Berry

[57] ABSTRACT

An apparatus for emptying sacks filled with bulk material comprising a feeder which transports filled sacks within the apparatus; a circular knife located such that, when the filled bag passes through the feeder, the circular knife cuts the bottom and sides of the bag; a receiving hopper for the bulk material; and an emptying assembly. The emptying assembly is comprised of two swivel plates which swing upwards and towards each other and an upright abutment plate which separately supports each side of the sack. In operation, the circular knife cuts the sack and the feeder loads the cut sack onto the swivel plates which swivel upward forcing the sack into contact with the abutment plate. Gravity forces the material from the sack into the receivimg hopper.

14 Claims, 4 Drawing Sheets

APPARATUS FOR TRANSPORTING AND EMPTYING SACKS FILLED WITH BULK MATERIAL

TECHNICAL FIELD

The present invention refers to an apparatus for emptying sacks filled with bulk material according to the generic clause of claim 1.

BACKGROUND OF THE INVENTION

In the case of a known apparatus of this type, the sack is passed through a door and put onto a supporting table, and, after closing the door, the sack is cut in two parts by means of a circular knife having a comparatively large diameter. The supporting table consists of two swivel plates defining a flat surface of said supporting table in their starting position. Below said swivel plates, swivelling frames are arranged, which are provided with pricks passing through holes in the swivel plates before said plates are swivelled upwards, said pricks penetrating into the sack in such a way that the two separate sack portions are firmly held during the upward motion of the swivel plates. The two sack portions are emptied due to the force of gravity and, if necessary, also by means of a shaking movement of the swivel plates. When the sack has been emptied, the swivel plates return to their starting positions, and this has also the effect that the pricks are removed from the swivel plates in a downward movement. The empty sack is then transported to an empty sack compacting means by means of a change-over flap, said empty sack compacting means consisting of a worm conveyor which is arranged in a casing.

In the case of this apparatus, there is the risk that parts of the paper sack are torn off and drop into the bulk material so that the further processing of the bulk material is endangered. Moreover, the raised sack portions hang freely on the associated swivel plates so that it can happen that the sack portions are not emptied completely.

SUMMARY OF THE INVENTION

The present invention is based on the task of further developing an apparatus of the above-mentioned type in such a way that complete and reliable emptying of the sack is guaranteed and that there is absolutely no risk that parts of the cut-open sack are introduced in the transport means together with the bulk material during the emptying process.

The characterizing features of claim 1 in combination with the generic clause are used for solving this task.

The apparatus according to the present invention additionally provides the possibility of discharging the bulk material by connecting a suction conduit to a receiving hopper or to a screw conveyor.

In accordance with an advantageous further development of the present invention, the suction conduit is provided with a change-over means with the aid of which the suction operation can also be carried out via a suck-in device connected to said change-over means through a flexible hose. When said suck-in device is used manually, a partial removal of a defined amount of bulk material from a sack is possible. While the suck-in device is being used, the sack emptying operation carried out with the aid of the swivel plates is interrupted.

BRIEF DESCRIPTION OF THE DRAWINGS

Additional features and advantages of the present invention will be evident from the description following hereinafter in connection with the drawing, which shows a schematic representation of an embodiment of the apparatus and in which.

DETAILED DESCRIPTION OF THE INVENTION

Figure 1:
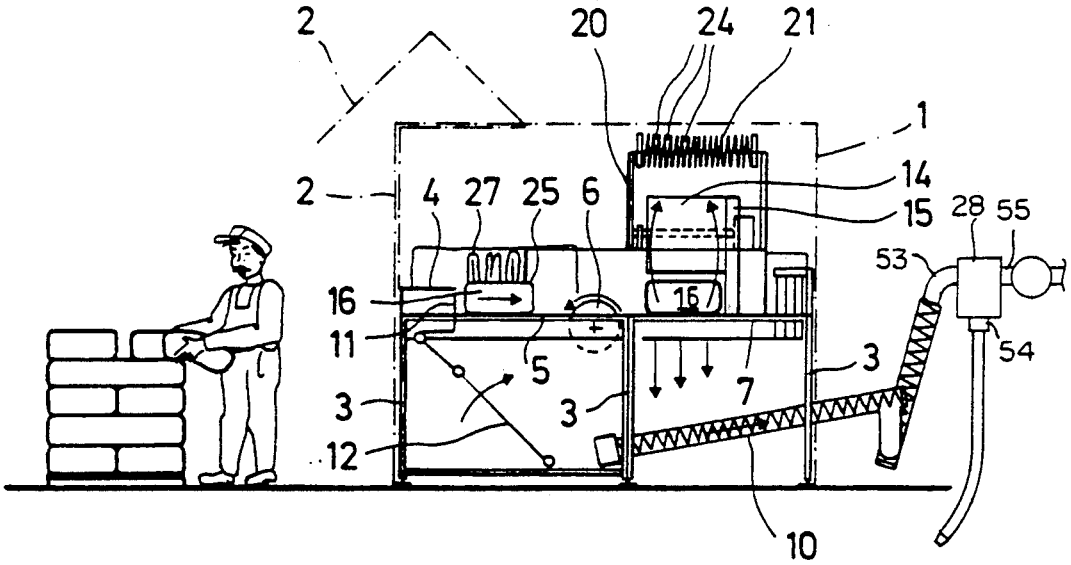
FIG. 1 shows a side view of the apparatus.

As indicated in FIG. 1 by a dot-and-dash line, the apparatus is arranged in a housing 1. The housing 1 of the apparatus has a swivelling door 2, which is outlined in FIG. 1 also in its raised position.

The apparatus is provided with a frame 3, which serves as a support for the various means. Directly behind the door 2, the frame 3 has attached thereto a stationary supporting table 4. This supporting table 4 is followed by a feed surface 5 on the frame, said feed surface 5 being positioned below the level of the supporting table 4.

At the end of the feed surface 5, a circular knife 6 is supported on said frame by means of a driving axle, said axle extending transversely to the direction of displacement of the sack. The cutting knife 6 can be caused to rotate in the direction of the arrow by means of a motor drive.

A supporting surface 7 follows the feed surface 5 on the same level, i.e. without any step between said surfaces, said supporting surface 7 being supported on said frame 3 as well.

The supporting surface 7 consists of two juxtaposed swivel plates 8, which closely abut on each other at the longitudinal centre in the horizontal position.

Below said swivel plates 8, a receiving hopper 9 is provided in said frame, said receiving hopper 9 having associated therewith a screw conveyor 10.

Figure 5:
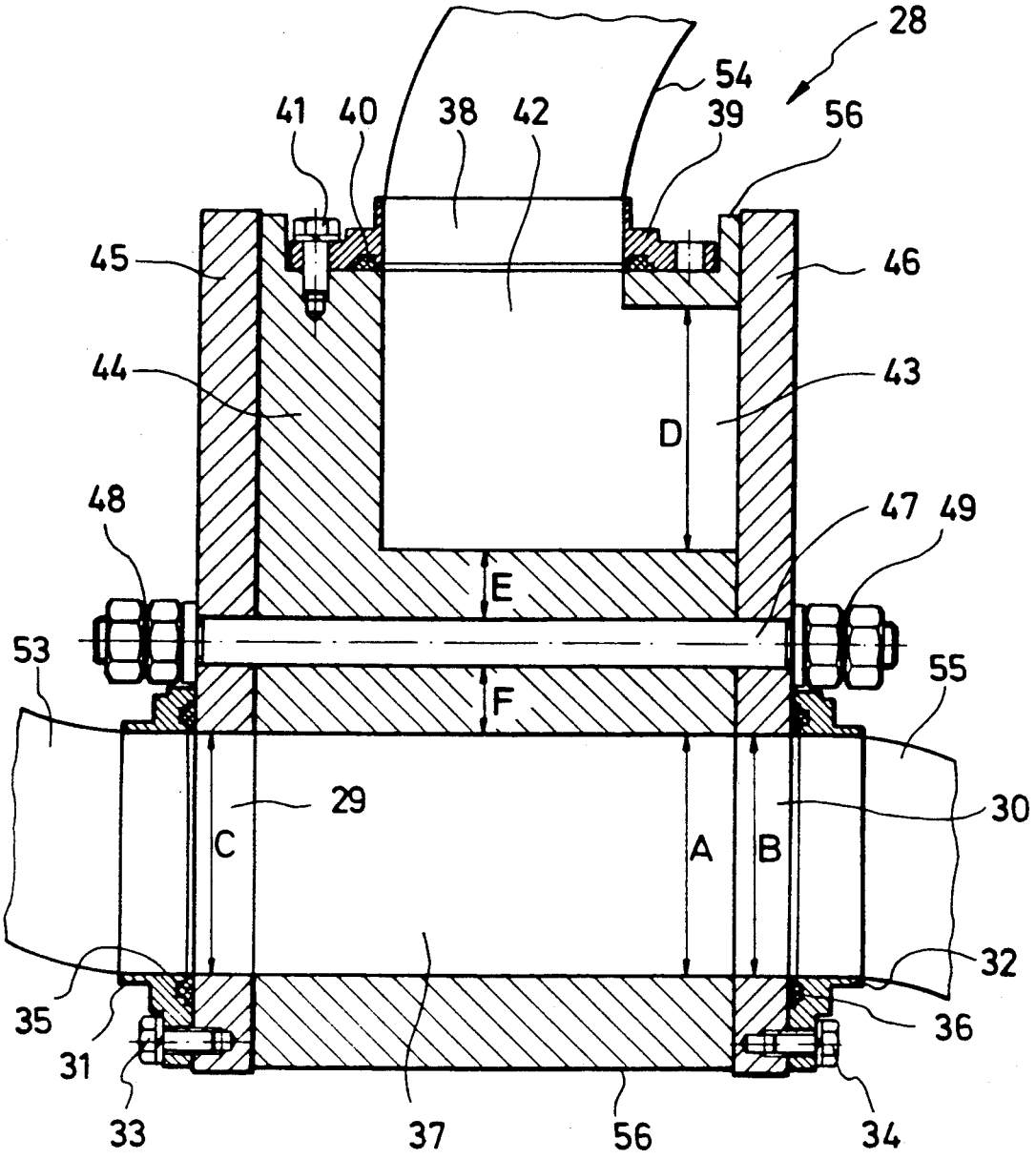
FIG. 5 shows a cross-section of the change-over means associated with the apparatus.
Figure 6:
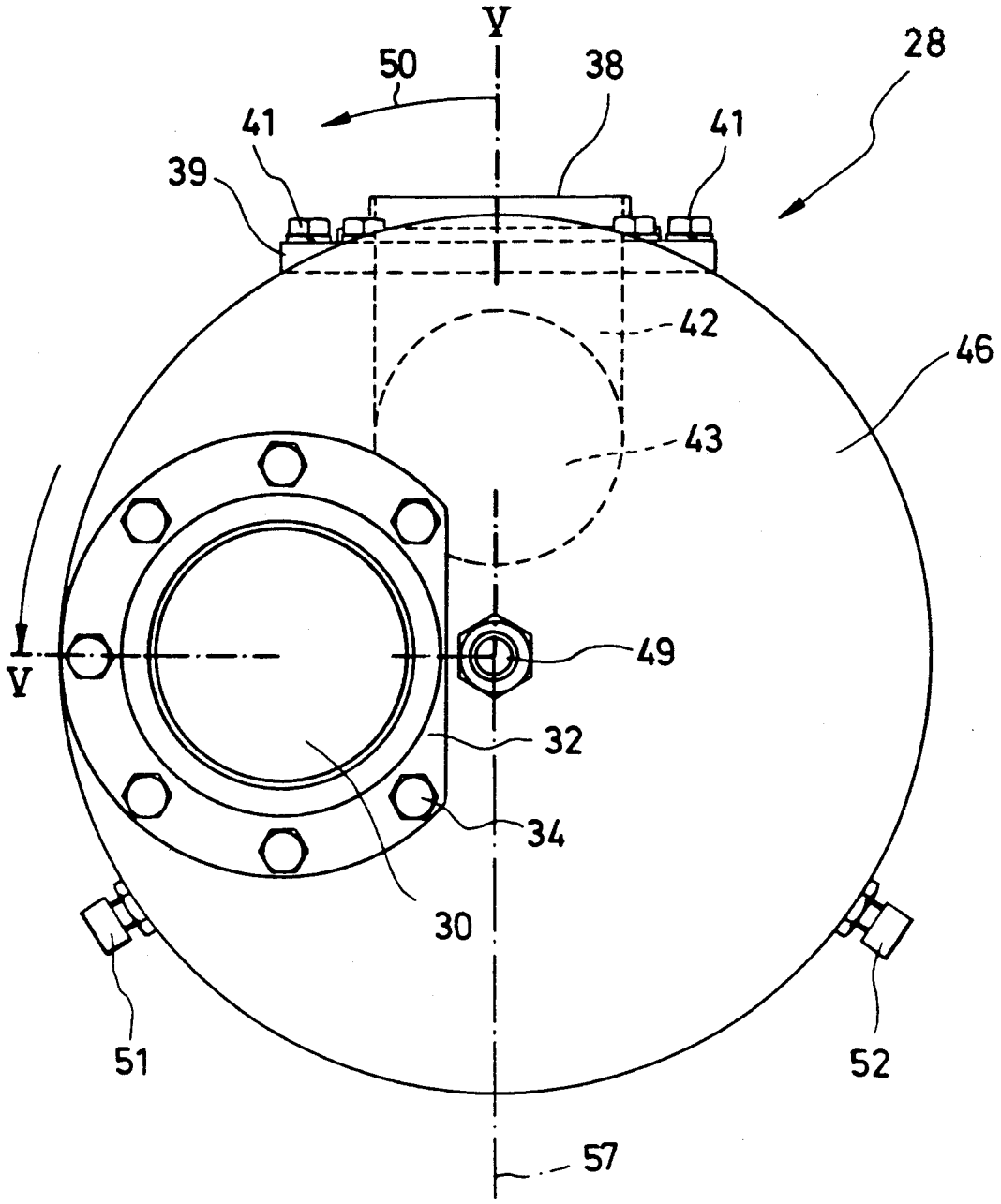
FIG. 6 shows a front view of the change-over means.

The screw conveyor 10 is adapted to have connected thereto a change-over means 28, which is shown in FIG. 5 and 6.

At the free end of the supporting table 4, a push-on bar 11 is arranged, which is supported by holding means (not shown) extending through longitudinal slots in the feed surface 5 and being themselves guided in a longitudinally displaceable manner and adapted to be driven by a crank drive 12. Each swivel plate 8 is supported on a swivelling shaft 13 such that it can be swivelled upwards, said swivelling shafts 13 being adapted to be displaced horizontally outwards in accordance with the directions of the arrows in FIG. 3. Above the joint between the two swivel plates an abutment plate 14 is arranged in a stationary manner after the fashion of a flag by means of a column 15, the lower edge of said abutment plate extending at a distance from the supporting surface 7 which exceeds the thickness of the full sack 16.

Figure 3:
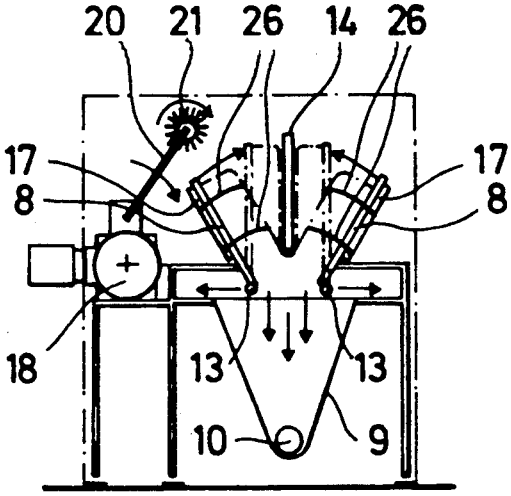
FIG. 3 shows a rear view of the apparatus.

A swivelling frame 17 is provided below each swivel plate 8, said swivelling frames being respectively adapted to be swivelled upwards separately in the same direction as the swivel plate 8 associated therewith. (FIG. 3). Each swivelling frame carries spikes 26, which are adapted to pass through holes provided in each swivel plate 8.

A worm casing 18 is supported on one side of the frame, the main axis of said worm casing extending parallel to the direction of displacement of the sack 16. A worm conveyor (not shown) is arranged within said worm casing 18.

The lower side of the worm casing 18 is provided with a slot 19 on one side thereof (FIG. 4), the length of said slot 19 exceeding the width of the sack 16.

Figure 4:
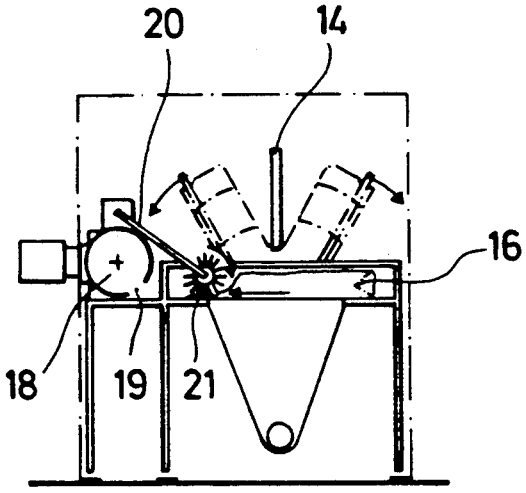
FIG. 4 shows the same view of the apparatus in the case of which the transport device for the empty sack is in its working position.

A brush roll 21 is supported by means of a swivelling holder 20. Said swivelling holder 20 is adapted to be swivelled about a swivelling shaft 22, which extends parallel to the longitudinal axis of the worm casing 18, from a position in which it is directed upwards at an oblique angle (FIG. 3) according to the direction of the arrow to a position in which the brush roll rests on the surface of the swivel plates 8 (FIG. 4).

The brush roll 21 is driven by a motor (not shown) in the direction of the arrow according to FIG. 3.

Figure 2:
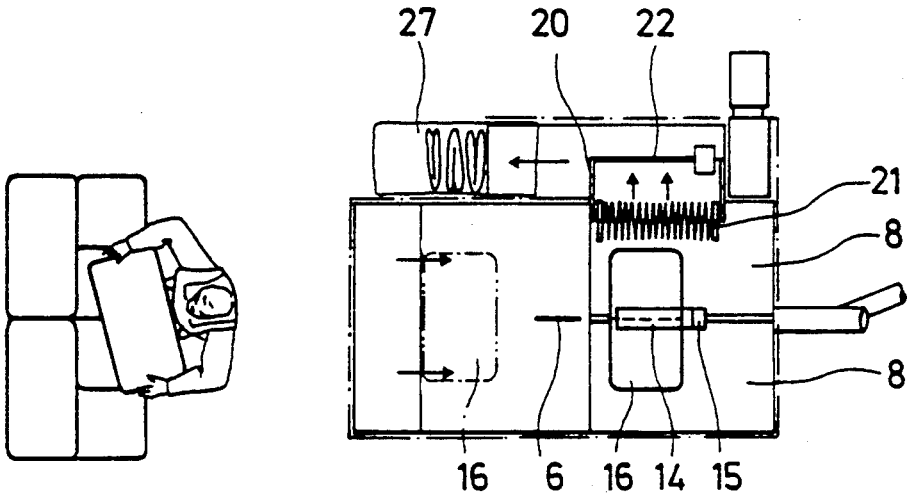
FIG. 2 shows a top view of the apparatus.

The worm casing 18 is provided with a tubular extension 27 at one end thereof (FIG. 1 and FIG. 2), the worm conveyor terminating in front of said tubular extension.

The brush roll is provided with plastic bristles 23, and between said plastic bristles 23 metal pins 24 are attached to the roll body, which project in the radial direction and which are a bit shorter than said plastic bristles 23.

In the case of a different embodiment, the brush roll 21 can consist of a cylindrical, rotatable metal basket having on its outer periphery radially projecting rubber profile strips which are arranged in the longitudinal direction of the cylinder.

FIG. 5 shows a cross-sectional view of a change-over means 28. Said change-over means 28 is adapted to be directly connected to the screw conveyor 10 and to the receiving hopper 9, respectively, via a suction conduit 53. With the aid of a connecting flange 31, the suction conduit 53 is connected to a suction conduit opening 29 of the change-over means 28. Said change-over means 28 consists of a cylindrical central body 44 and of two discs 45 and 46, which are attached to the ends of said central body. The discs 45 and 46 are centrally fixed relative to each other by the rotary shaft 47 and screws 48 and 49. The central body 44 is arranged concentrically with the rotary shaft 47 and is adapted to be rotated about said rotary shaft and relative to the discs 45 and 46.

The suction conduit opening 29 is formed eccentrically to the rotary shaft 47 in the disc 45. The connecting flange 31 and the suction conduit opening 29 have essentially the same diameter C. A sealing ring 35 is arranged between the connecting flange 31 and the suction conduit opening 29 so as to provide a sealing effect, and the flange 31 is adapted to be connected to the disc 45 with the aid of screws 33.

The disc 46 has formed therein a pump opening 30, which is coaxial with the suction conduit opening 29 of the disc 45. The diameter B of this opening corresponds to the diameter C of the suction conduit opening 29. The pump opening establishes in a corresponding manner a connection 55 to a suction pump with the aid of a flange 32, a sealing ring 36 and screws 34.

The central body 44 has formed therein a linear passage 37 eccentrically to the rotary shaft 47. This passage extends parallel to the rotary shaft 47 at a distance F therefrom, and, in the rotary condition of the central body 44 shown in FIG. 5, it connects the suction conduit opening 29 and the pump opening 30. The diameter A of the linear passage 37 corresponds in this case to the diameters B and C, respectively, of the openings 29 and 30 provided in said discs 45 and 46. Hence, the linear passage 37 is arranged in FIG. 5 such that it is in alignment with the suction conduit opening 29 as well as with the pump opening 30.

The central body 44 has formed therein a connection passage 42 arranged centrally between the discs 45 and 46 in the periphery 56 thereof and extending in the directon of the rotary shaft 47. This connection passage 42 is, radially outwards, followed by a connecting flange 39 arranged in a recessed portion of the central body Said connecting flange 39 is connected to the central body 44 with the aid of a sealing ring 40 and screws 41. The connecting flange has connected thereto a hose 54, which is provided with a suck-in device at its other end, which is not shown. The connection passage 42 is followed by a pump connection passage 43, which extends parallel to the rotary shaft 47 at a distance E therefrom and which defines a continuation of the connection passage 42 at right angles thereto. This pump connection passage 43 has a diameter D, which corresponds to the diameter B of the pump opening 30. The pump connection passage 43 extends through the central body 44 up to the disc 46. The distances E and F of the pump connection passage 43 and of the linear passage 37 are identical so that, when the central body 44 has been rotated about the rotary shaft 47, an aligned connection is established between the pump connection passage 43 and the pump opening 30.

FIG. 6 shows a front view of the change-over means 28 from the side located opposite the sack emptying apparatus.

In this representation, the rotary shaft is secured to the disc 46 with the aid of the screw 49. The pump opening 30 is arranged in parallel displaced relationship with the screw 49. Said pump opening 30 is continued by a connecting flange 32, which is attached to the disc 46 by means of screws 34, so that a connection to the pump can be established.

At the periphery of the disc 46, the connecting flange 39 surrounding the opening 38 is visible at least partially. In conformity with the connecting flange 32 of the pump opening 30, said connecting flange 39 is attached to the central body 44 by a number of screws 41, cf. also FIG. 5. In the direction of the disc centre, which is defined by the screw 49, the opening 38 is continued by the connection passage 42. Said connection passage 42 is followed by the pump connection passage 43 at right angles in the direction of the disc 46.

The representation of the change-over means 28 according to FIG. 5 corresponds to a section along the line V—V in FIG. 6. In the representation according to FIG. 6, the pump connection passage 43 and the pump opening 30 are arranged such that they are displaced by 90° relative to each other with regard to the screw 49. When the central body is rotated by 90° in direction 50, the pump connection passage 43 and the pump opening 30 are connected such that they are in alignment with each other.

At two points of the periphery of the disc 46, two stop means 51 and 52, which are arranged symmetrically with regard to the vertical axis 57 and which consist of screws, can be seen on the central body 44, which is not visible in this figure.

In the following, the mode of operation of this apparatus will be described.

After having opened the door 2 of the housing, the operator will put a sack 16, which is filled with bulk material, on the supporting table 4 in such a way that the sack is positioned transversely relative to the direction of displacement.

Following this, the operator will move said sack beyond the supporting table 4 so that the sack will slide onto the feed surface 5 and come to rest there.

Subsequently, the cutting knife 6 is caused to rotate in the direction of the arrow according to FIG. 1 and the push-on bar 11 is caused to start moving by means of the crank drive 12 so that said push-on bar 11 will come into contact with the sack positioned in front of said bar on the feed surface and displace said sack in the direction of the arrow until it reaches its end position on the swivel plates 8. This is possible because the push-on bar has provided therein a vertical slot permitting said bar 11 to be pushed onto the cutting knife 6.

The structural design of the cutting knife 6 is of such a nature that the top of the cutting knife is positioned on a lower level than the upper side 25 of the sack. It follows that the sack will be cut open on the underside and on the transverse sides, whereas the upper side will not be cut.

As soon as the sack 16 has reached its end position on the swivel plates 8 (FIG. 1 and 2), the swivelling frames 17, which are located below the swivel plates 8, are swivelled into contact with the underside of said swivel plates, and this will have the effect that the spikes 26 secured to the swivelling frame 17 pass through the openings in said swivel plates 8 and penetrate into the full sack.

Following this, the swivelling frames 17 are swivelled upwards together with the swivel plates 8 in the direction of the arrows according to FIG. 3, and in the course of this movement the swivelling shafts 13 are displaced horizontally outwards, as indicated in FIG. 3.

When the swivelling frames 17 and the swivel plates 8 occupy their vertical positions (FIG. 3), each sack portion is held by the spikes 26 and is, moreover, pressed against the abutment plate 14 by means of the swivel plate 8 associated therewith, and, being pressed together, each sack portion will inevitably be emptied separately. In the course of this process, the non-cut upper side 25 of the sack will be bent round the lower edge of the abutment plate 14 so that the sack portions are opened completely at the lower side, since also the transverse sides of the sack are cut open so that the bulk material will fall into the receiving hopper 9 due to the force of gravity, as indicated by the arrows in FIG. 3. The bulk material is then transported away by the screw conveyor 10.

When the sack portions have been emptied, the swivel plates 8 will first return to their starting position together with the swivelling frames 17, as indicated in FIG. 4. When the swivel plates 8 have taken up their horizontal positions, the swivelling frames 17 will additionally swivel downwards to such an extent that the pricks will be removed from the holes provided in the swivel plate, whereupon the upper sides of the swivel plates will form a smooth surface.

The empty sack then lies in an extended position on the surface of the swivel plates 8, as can be seen in FIG. 4. In view of the fact that the sack normally consists of a comparatively stiff paper, the empty sack will not collapse completely, but will have some height also in the empty condition.

The brush roll 21 is now caused to rotate in the direction of the arrow according to FIG. 3 and the swivelling holder 20 is swivelled downwards until the brush roll 21 is pressed onto the end of the empty sack lying below said roll, as can be seen in FIG. 4. The empty sack is not only pressed together flatly by the brush roll 21, but it is also transported towards the worm casing 18 in this flat condition, and, having reached said worm casing, the flat sack will enter said casing through the comparatively narrow slot 19 and will be seized by the rotating worm conveyor and transported within the casing in the longitudinal direction of said casing.

The sack then gets stuck in the extension 27 of the worm casing 18 and, due to its friction, it is pressed together on the wall of the extension by the empty sacks following said sack. This effect can additionally be intensified by an extension having a conically tapering shape.

In view of the fact that the sack is not cut in two parts, but is only cut open in such a way that the two sack portions are still joined, there is no risk that parts of the sack material come off and are introduced into the hopper together with the bulk material.

Nor does this risk exist when the sack portions are being emptied, since a substantial force is applied for pressing the sack portions onto the abutment plate 14 until they have been emptied completely.

Due to the use of the brush roll as a conveyor means for the empty sack, said sack is flattened during transport to such an extent that the slot 19 in the worm casing 18 has to have only a very small height so that the casing 18, which is made of sheet metal, is practically not weakened and can, consequently, not be deformed during transport of the empty sack by the worm conveyor so that a uniform transport effect of the worm is guaranteed.

The spikes 26, which are additionally provided on the brush roll, take hold of the empty sack without any delay, which might perhaps be caused if the empty sack were acted upon by the plastic bristles alone.

Moreover, the plastic bristles are thus protected against excessive wear, since sliding of the plastic bristles across the empty paper sack is avoided to a large extent.

The whole sequence of operations in the apparatus can be rendered fully automatic. This can be done in a simple manner by sequential switching. When the full sack 16 lies on the feed surface 5, the door 2 is closed. This closing operation switches on the drive for the knife and puts the push-on bar 11 in motion. When the push-on bar 11 has reached its front end position, the swivel drive for the swivelling frames 17 and the swivel plates 8 is started. At the same time, a dust removal device can be activated.

When the swivel plates 8 have reached their pressure-exerting positions for emptying the sack, the push-on bar 11 can be returned to its starting position by actuating the crank drive 12, and, after some shaking movement, also each swivel plate and the associated swivelling frames are returned to their starting positions; for these processes, a specific period of time can be kept free by a timing relay.

When the swivel plates have reached their starting positions, the drive means of the brush roll 21 and the drive means effecting the downward movement of the swivelling holder 20 are actuated until the brush roll is pressed onto the empty sack. The sack can then be transported away by making use of a timing relay, whereupon the swivel drive for the brush roll is actuated again and moves the swivelling holder upwards, the drive means of the brush roll being stopped at the same time.

The worm conveyor can continuously operate during the whole process.

It is, of course, also Possible to supply the sacks to the feed surface 5 mechanically.

The change-over means 28 provides the possibility of supporting the transport of the bulk material by means of sucking off. The receiving hopper 9 as well as the screw conveyor 10 are adapted to be connected to a suction pump via a suction conduit 53 and with the aid of the change-over means 28.

In a first position of the change-over means 28, the suction conduit and the suction pump are interconnected by a linear passage 37 and the bulk material is sucked out of the sack emptying apparatus.

If a precisely defined amount of bulk material is to be sucked off with the aid of the pump, it is possible to manually remove from a sack this defined amount with the aid of a suck-in device, which is connected to the hose, in a second position of said change-over means 28. Change-over between said first and second positions of the change-over means 28 can be effected by pulling at the hose connected to the change-over means. The rotatable central area 44 is thus displaced by an angle of 90° and the hose and, consequently, the suck-in device are connected to the pump via the connection passage 42 and the pump connection passage 43. At the same time, the sack emptying apparatus is switched of automatically, e.g. via a position indicator, with the aid of stop means arranged radially on the periphery of the central body, i.e. no other sacks will be emptied with the aid of the swivel plates 8 as long as bulk material is manually sucked out of a sack with the aid of the hose.

When a defined amount has manually been removed from the sack in this way, the central body 44 of the change-over means 28 is again rotated to its other position. The hose is no longer connected to the pump and, due to the rotation of the stop means, the position indicator reactivates the sack emptying apparatus, swivel plates, knives etc. Through the linear passage, which is now again arranged in alignment with the pump opening 30 and the suction conduit opening 29, the sacks supplied by the push-on bar 11 will now again be emptied with the aid of the screw conveyor 10 and the receiving hopper 9, respectively.

I claim:

1. An apparatus for emptying a sack filled with bulk material, the sack having a bottom, a top, and transverse sides, the apparatus comprising a feed device transporting the sack within the apparatus, a cutting device in the form of a circular knife, and means for emptying the sack, said emptying means including a support surface and a receiving hopper receiving the bulk material, said feed device adapted to transport the sack from a feed surface onto said support surface, said cutting device arranged at said feed surface such that its top is positioned on a lower level than said sack top, said cutting device cutting said sack bottom into first and second sack portions, said support surface of said emptying means being adjacent first and second swivel plates having inner edges near each other and outer edges away from each other, said swivel plates adapted to swivel upwards from horizontal by moving their outer edges toward each other, said first and second swivel plates having spikes holding said first and second sack portions, respectively, during swivelling, said emptying means further including an upright abutment plate arranged above said first and second swivel plates when said first and second swivel plates are in their horizontal positions, said abutment plate having first and second abutment surfaces for abutting said top of said sack when said first and said second swivel plates are in their upright positions, said abutment plate further including a lower edge above said first and second swivel plates when they are in their horizontal positions, said lower edge abutting said top of said sack substantially between said first and second sack portions when said swivel plates are in their upright positions.

2. The apparatus according to claim 1, wherein the inner edge of each of the first and second swivel plates is provided with a swivel shaft, and wherein said emptying means causes said swivel shafts to horizontally move away from each other.

3. The apparatus according to claim 2, wherein the feed device includes a push-on bar having a slot to permit passage of the circular knife while the sack is moved onto the swivel plates.

4. The apparatus according to claim 1, including a suction conduit operatively connected with the receiving hopper and transporting away bulk material, wherein said suction conduit communicates with one opening of at least three openings of a change-over means while a second one of the remaining openings is connected to a pump, and a third one of the remaining openings is connected to a hose, said change-over means provided with a central body adapted to be rotated relative to the suction conduit opening and the pump opening and which has formed therein passages for connecting the pump opening either to the suction conduit opening or to the hose opening.

5. The apparatus according to claim 4, wherein the central body is substantially cylindrical and is supported such that it is rotatable relative to a rotary shaft that is arranged concentrically with a longitudinal axis of said central body, between two coaxial discs.

6. The apparatus according to claim 5, wherein the pump opening and the suction conduit opening are each formed in a respective one of the discs such that they are coaxial, identical in cross-section and eccentric with regard to the rotary shaft, and that the connection between said openings can be established by a linear passage which has the same cross-section and which is formed in the central body.

7. The apparatus according to claim 6, wherein the hose opening is formed on a periphery of the central body, said hose opening extends into the central body along a radially extending connection passage which is followed by a pump connection passage extending eccentrically with regard to the rotary shaft, said pump connection passage having the same cross-section as the linear passage and extending at a distance from the rotary shaft which corresponds to the distance between said rotary shaft and said linear passage.

8. The apparatus according to claim 7, wherein, relative to the rotary shaft, the linear passage and the pump connection passage are arranged at an angle of substantially 90°.

9. The apparatus according to claim 4, wherein the central body has arranged on its periphery two radially projecting stop means for determining two suction positions.

10. The apparatus according to claim 9, wherein at least one of said stop means is connected to a position indicator.

11. An apparatus for emptying sacks filled with bulk material, comprising a feed device transporting the sack within the apparatus, a cutting device in the form of a circular knife for cutting a lower side of said sack into a first and second sack portion while an upper side of said sack remains uncut, and an emptying device having a first swivel plate supporting said first sack portion and a second swivel plate supporting said second sack portion, said swivel plates being placed one adjacent the other with inner edges facing each other and outer edges facing away from each other, and being adapted to be swivelled upwards, and back from a horizontal position into an upright position by moving their outer edges towards and away from each other when supporting said sack portions, said apparatus further including a transport means for transporting the cut empty sack to an empty sack compacting means, the transport means consisting of a brush roll, which is adapted to be rotated and which is supported on a swivelling holder, said holder pressing, when swivelled downwards, the brush roll onto the sack spread out on the two swivel plates which have been moved back into the horizontal position, an empty sack compacting means being provided to receive said empty sack from said brush roll, said empty sack compacting means consisting of a worm conveyor arranged within a casing and said casing having on one side thereof an inlet slot for the empty sack flattened by the brush roll.

12. The apparatus according to claim 11, wherein the feed device is provided with a push-on bar having a slot to permit passage of the circular knife while the sack is moved onto the swivel plates.

13. The apparatus according to claim 11, wherein the brush roll is provided with plastic bristles and with some metal pins between said bristles.

14. An apparatus according to claim 11, further including a receiving hopper for receiving the bulk material from said sack, said apparatus having arranged thereon a suction conduit, which communicates with the receiving hopper, for transporting away the bulk material, said suction conduit communicating with one opening of at least three openings of a change-over means, while a second one of the remaining openings being connected to a pump and a third one being connected to a hose, said change-over means being provided with a central body, which is adapted to be rotated at least relative to the suction conduit opening and the pump opening and which has formed therein passages for connecting the pump opening either to the suction conduit opening or to the hose opening.

* * * * *